United States Patent [19]

Nomura

[11] 4,255,094

[45] Mar. 10, 1981

[54] AUTOMATIC PRESSURE HOLDING ELECTROMAGNETIC PUMP

[75] Inventor: Atsushi Nomura, Tokorozawa, Japan

[73] Assignee: Nippon Control Ind. Co., Ltd., Tokyo, Japan

[21] Appl. No.: 11,567

[22] Filed: Feb. 12, 1979

[30] Foreign Application Priority Data

Mar. 4, 1978 [JP] Japan ..... 53/24633

[51] Int. Cl.[3] ..... F04B 49/00

[52] U.S. Cl. ..... 417/311; 417/417

[58] Field of Search ..... 417/253, 254, 268, 416, 417/417, 418, 311

[56] References Cited

U.S. PATENT DOCUMENTS

| | | | |
|---|---|---|---|
| 3,877,840 | 4/1975 | Nakamura | 417/417 X |
| 3,958,902 | 5/1976 | Toyoda et al. | 417/417 X |
| 4,021,152 | 5/1977 | Toyoda | 417/417 |
| 4,169,695 | 10/1979 | Masuda et al. | 417/417 X |

*Primary Examiner*—Edward L. Roberts

*Attorney, Agent, or Firm*—Wenderoth, Lind & Ponack

[57] ABSTRACT

An electromagnetic pump having a pressure adjusting function that holds discharge pressure constant; a decompression valve for throttling an outflow is provided in the path of the discharge side and this decompression valve is displaced by a pressure receiving plunger to which the pressure of the discharge side is applied. The pressure receiving plunger is slidably provided in a cylinder, and a pressure adjusting spring facing the pressure receiving plunger of the cylinder is disposed in the chamber located on the opposite side of the decompression valve; a return path communicating with a suction side of the electromagnetic pump is formed in the chamber. The pressure is adjusted by the decompression valve, and the fluid leaking into the chamber located on the opposite side of the decompression chamber of the cylinder is returned to the suction side by means of the return path.

5 Claims, 4 Drawing Figures

AUTOMATIC PRESSURE HOLDING ELECTROMAGNETIC PUMP

BACKGROUND OF THE INVENTION

Normally, in an electromagnetic pump, an electromagnetic plunger and a pressure piston connected to the electromagnetic plunger are made to reciprocate by means of an interrupted electromagnetic force of an electromagnetic coil and the pumping action of the pump is effected by a suction valve and a discharge valve working together. In order to keep the discharge pressure of the electromagnetic pump constant, so far, there have been two systems developed.

One system which has been developed is a relief valve system for returning the extra outflow to the suction side of the pump, and the other system which has been developed is a pressure sensitive control decompression valve system that senses the pressure at the discharge side of the pump to control the outflow by throttling down the path cross-sectional area at the discharge side of the pump.

The relief valve system is described in the specification of U.S. Pat. No. 3,877,841, wherein a predetermined discharge pressure is set by returning the fluid to the suction side of the pump from the discharge side of the pump by means of a relief valve; however, such a pump always has a large constant piston stroke as the performance must be set above the required outflow to compensate for the performance drop due to the temperature rise of the electromagnetic coil and to provide compensation for changes of the discharge pressure in response to a fluctuation (primarily, $\pm 10\%$) of the input voltage. The required large constant piston stroke gives rise to unnecessary excess vibration or noise.

Also, since the piston stroke is large, there is a need to provide a pressure accumulator for the prevention of pressure pulsation. Furthermore, in many cases, the relief valve is made of a soft material such as rubber in order to produce the desired performance as far as the pump structure is concerned; the use of such material results in accelerated pump deterioration and severely limited pump service life. The failure of the relief valve reduces the discharge pressure and in the case where the pump is used in conjunction with a combustor, it results in incomplete combustion of the pumped fuel.

The pressure sensitive control decompression valve system is arranged such that a decompression valve is provided in the flow path at the discharge side of the pump and the decompression valve is displaced by the discharge side pressure to control the outflow of the discharge side, whereby the piston stroke can be set to a required minimum in proportion to the discharge outflow; the smaller piston stroke results in a lower noise level than that for the relief valve system and furthermore, no accumulator is required, both of which are significant advantages. Existing pressure sensitive control valve systems can be roughly classified into the following two methods with respect to their pressure receiving mechanisms configuration.

One method uses a diaphragm as the pressure receiving mechanism and has drawbacks which occur frequently, such as the loss of effect of the diaphragm because of the fact that the fluid used saturates the diaphragm material due to long hours of use, and because of the fact that fluid is collected in the chamber on the housing side of the spring, thus varying the pressure on the diaphragm or causing the breakage of the diaphragm.

A second method uses a metal bellows as the pressure receiving mechanism and has other drawbacks, such as cracks therein due to long hours of use in an electromagnetic pump having large pressure fluctuations or lack of practicality with regard to high bellows fabrication costs. Furthermore, as described in the foregoing, the diaphragm and the bellows, which form the pressure receiving mechanisms, are broken due to the high pressure and the change of chemical/physical property thereof caused by the fluid used and deterioration due to the influence of physical fatigue caused by the pressure pulsation; there is also the danger of causing excessive outflow at the maximum performance of the electromagnetic pump if the pumped fluid is applied at an excessively high pressure directly to a nozzle. As described in the foregoing, many various problems occur in the conventional pressure adjustments of the discharge pressure.

SUMMARY OF THE INVENTION

A first object of the present invention is to provide an automatic pressure holding electromagnetic pump to which a relief system based on the pressure sensitive control decompression valve system is applied, and is capable of keeping the discharge pressure constant by changing the throttle amount of the decompression valve in response to fluctuations of the discharge pressure.

A second object of the present invention is to provide an automatic pressure holding electromagnetic pump which has a structure arranged such that a gap between the pressure receiving plunger used as a pressure receiving mechanism and a cylinder in which the plunger slides is adjusted on the basis of a minimum leakage of the fluid; even if there is slight leakage from the gap thereof, the leaked fluid is returned to the suction side, and therefore a complete sealing between the pressure receiving plunger and the cylinder is not required. As a result, the sliding resistance of the pressure receiving plunger can be made extremely small, and the decompression valve for controlling the discharge amount of the discharge fluid can operate smoothly and sensitively.

Furthermore, a third object of the present invention is to provide an automatic pressure holding electromagnetic pump having excellent durability wherein a conventional diaphragm is not used as the pressure receiving mechanism, and a metal pressure receiving plunger sliding in a cylinder is substituted therefor.

A fourth object of the present invention is to provide an automatic pressure holding electromagnetic pump which can be manufactured with relatively moderate dimensional accuracy since a certain leakage from the gap between the pressure receiving plunger and the cylinder is allowed, resulting in decreased machining costs.

A fifth object of the present invention is to provide an automatic pressure holding electromagnetic pump capable of changing the piston stroke of the piston in response to the discharge pressure, thereby lowering the vibration and noise when the stroke is reduced to the required minimum which matches the required discharge amount.

A sixth object of the present invention is to provide an automatic pressure holding electromagnetic pump capable of improving its pulsation preventing effect when used with an accumulator since the pump is provided with a pressure receiving mechanism.

BRIEF DESCRIPTION OF THE DRAWINGS

Although these objects can be achieved by the present invention, the concrete embodiments will become obvious by referring to the attached drawings and the detailed description.

DETAILED DESCRIPTION OF THE INVENTION

Figure 1:
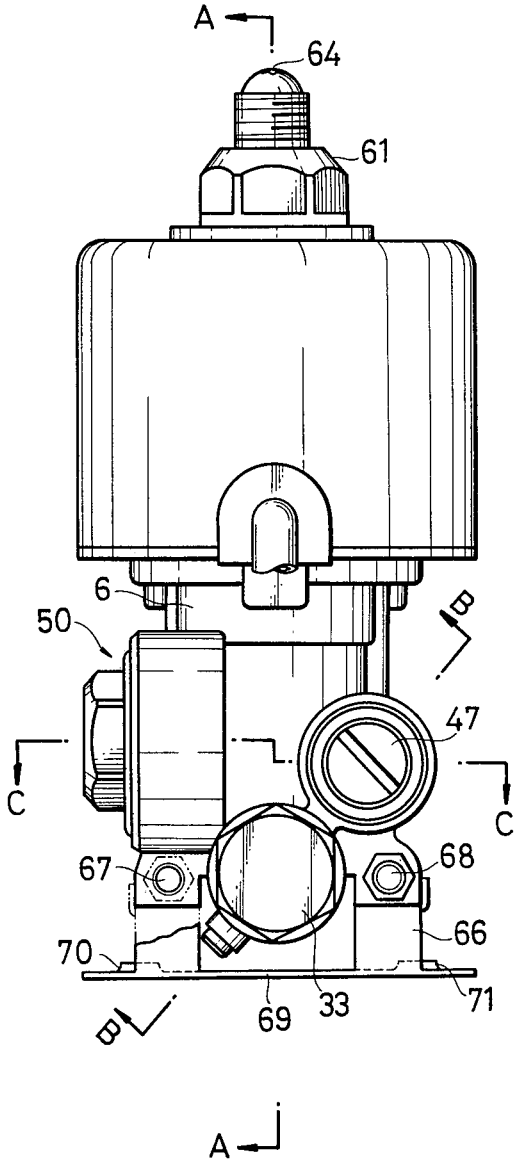
FIG. 1 is an elevation of an automatic pressure holding electromagnetic pump in accordance with one embodiment of the present invention.

An electromagnetic pump according to one preferred embodiment of the present invention is illustrated in FIG. 1 through FIG. 4. An electromagnetic plunger (1) is caused to reciprocate by an electromagnetic coil (2). The electromagnetic plunger (1) is supported in an electromagnetic plunger operation chamber (7) consisting of a guide case (5) and a pump proper (6), by an upper holding spring (3) and a lower holding spring (4). Chamber (7) is separated into an upper spring chamber (7*a*) and a lower spring chamber (7*b*) by the electromagnetic plunger (1). A hole (8) is bored in the axial direction in the electromagnetic plunger (1), and the upper spring chamber (7*a*) and the lower spring chamber (7*b*) are communciated by the hole (8).

A piston (9) is integrally connected to the electromagnetic plunger (1), and is inserted into a cylinder (10). This cylinder (10) is disposed in a cylinder inserting hole (11) connected to the lower spring chamber (7*b*) by means of an elastic material (12). The cylinder (10) is formed with a spring receiver (13) that receives the lower spring (4); the spring force is applied to the cylinder (10) by means of the spring receiver (13).

A suction side check valve (14) and a discharge side check valve (15) are disposed in a connected valve seat member, and the combination is inserted into a valve inserting hole (16) of the pump proper (6). The check valve (14) of the suction side is compressed and seated on a valve seat member (17) of the suction side by means of a spring (18); the valve seat member (17) is connected to a member (20) provided with a strainer (19) at one end thereof. A discharge side seat member (21) is connected to the other end of check valve (14). The discharge side check valve (15) is compressed and seated on the discharge side valve seat member (21) by means of a spring (22), and a valve cylinder (23) holding the spring (22) is screwed to the valve seat member (21).

If the suction side check valve (14) and the discharge side check valve (15) are arranged so as to be directly seated on the valve seat members (17) and (21), the seating surfaces thereof tend to wear out quickly. Accordingly, members (24), (25), which are fabricated to have high wear resistance, are mounted on the valve seat members (17), (21) so that valves (14) and (15) seat thereon, thus prolonging the service life of the pump.

An O ring (26) is provided on an outer periphery of the valve seat member (21), and is seated in the valve inserting hole (16) to separate the pressure chamber (28) from the discharge chamber (29). The O ring (27) is provided on an outer periphery of the valve seat member (17).

A suction side coupling (30) is screwed to the pump proper (6), and the fluid is sucked through a suction hole (31) of the suction side coupling (30), and is led to the pressure chamber (28) through holes (100) drilled in valve seat member (21) and through a conduit hole (32) after passing through the strainer (19). This conduit hole (32) is bored with a hole (34) communicating with a return path (49). A discharge plug (33) closes one of the valve inserting holes (16). A pressure adjusting mechanism (134) communicates with the discharge chamber (29), and is provided on a discharge side path (35) leading to the lower spring chamber (7*b*); a decompression valve (36) is disposed on the path (35), and an area of the flow path is appropriately throttled by means of the decompression valve (36) and a throttle hole (37), so that the outflow of the flowing fluid can be controlled.

The decompression valve (36) is disposed in a chamber (35*a*) of the upper stream side of the throttle hole (37), and the spring force of spring (44) disposed in the chamber (35*a*) is compressed to the throttle hole (37) side by means of a spring receiver (64). The decompression valve (36) is controlled by the movement of a pressure receiving plunger (39), serving as the pressure receiving mechanism, and is connected thereto by means of a rod (38). The area of the flow path of the throttle hole (37) is changed by the displacement of the pressure receiving plunger (39).

The pressure receiving plunger (39) is slidably disposed in a cylinder (40) formed on the pump proper (6), and is disposed downstream of the throttle hole (37). A chamber (35*b*) formed by a pressure receiving surface of the plunger (39) and the cylinder (40) is communicated with the lower spring chamber (7*b*) by means of a path (35*c*). An O ring (41) is formed on an outer periphery of the pressure receiving plunger (39), but the leakage of a small amount of the fluid is permitted through the gap formed between the pressure receiving plunger (39) and cylinder (40).

A pressure adjusting spring (43), facing the pressure receiving plunger (39) of the cylinder (40), is housed in the decompression valve opposite chamber (42), and the pressure receiving plunger (39) is compressed in the direction of the decompression valve side by means of the pressure adjusting spring (43). Accordingly, the decompression valve (36) is shifted by resistance to spring (44) having a small load when fluid is sucked into the pump, and thus the degree of opening of the throttle hole (37) reaches its maximum value. Reference numeral (45) denotes a pressure adjusting screw; when this screw is turned, the setting power of the pressure adjusting spring (43) can be adjusted, thus adjusting the discharge pressure; the adjusting position of the screw can be fixed by means of a lock nut (46). Reference numeral (47) denotes a valve case; the valve case (47) has a valve seat (48) and has a throttle hole (37) provided at the front thereof; when this valve case (47) is screwed to one end of the cylinder (40), it can be adjusted so as to be at any desired position in the cylinder (40).

A return path (49) opens to the chamber (42) of the opposite side of the decompression valve of the cylinder (40) at its one end, and the other end opens to the suction side of the electromagnetic pump. Accordingly, the fluid gathered in the chamber (42) of the opposite side of the decompression valve of the cylinder (40) is returned to the suction side from time to time by means of the return path (49) due to the negative pressure at the suction side.

An accumulator (50) is of a cylindrical shape and its accumulator case (51) is provided integrally with the pump proper (6), and is communicated with the lower spring chamber (7*b*). In case (51), a diaphragm (52) is affixed with a cap (54) and a diaphragm holder (53). Reference numeral (55) denotes a spring interposed between the cap (54) and the diaphragm (52), and reference numerals (56) and (57) denote spring receivers. The diaphragm (52) in combination with the spring (55) are sufficiently flexible to absorb pressure pulsations of the fluid in chamber (7*b*).

A lower end of a fixed magnetic rod (58) is fitted in the upper part of the guide case (5), and is provided above the electromagnetic plunger (1); a fluid flow path (59), communicating with a discharge outlet (64), is formed on the axial center of the rod (58). An electromagnetic valve (60) is provided in a discharge coupling (61), and the discharge coupling (61) is screwed to the magnetic rod (58). The structure of the electromagnetic valve (60) is composed of a movable iron member (60*a*) and a rubber valve (60*b*); the valve (60*b*) is compressed by a spring (62) acting with the movable iron member (60*a*); the valve (60*b*) is seated on a valve seat (63) to close the discharge outlet (64). This electromagnetic valve (60) is moved by resistance to the spring (62) by a magnetic force when an electric current is supplied to the electromagnetic coil (2) to thereby open the discharge outlet (64); the fluid is discharged from the discharge outlet (64) after passing the through hole (60*c*) formed on the movable iron member (60*a*) of the electromagnetic valve (60).

Figure 2:
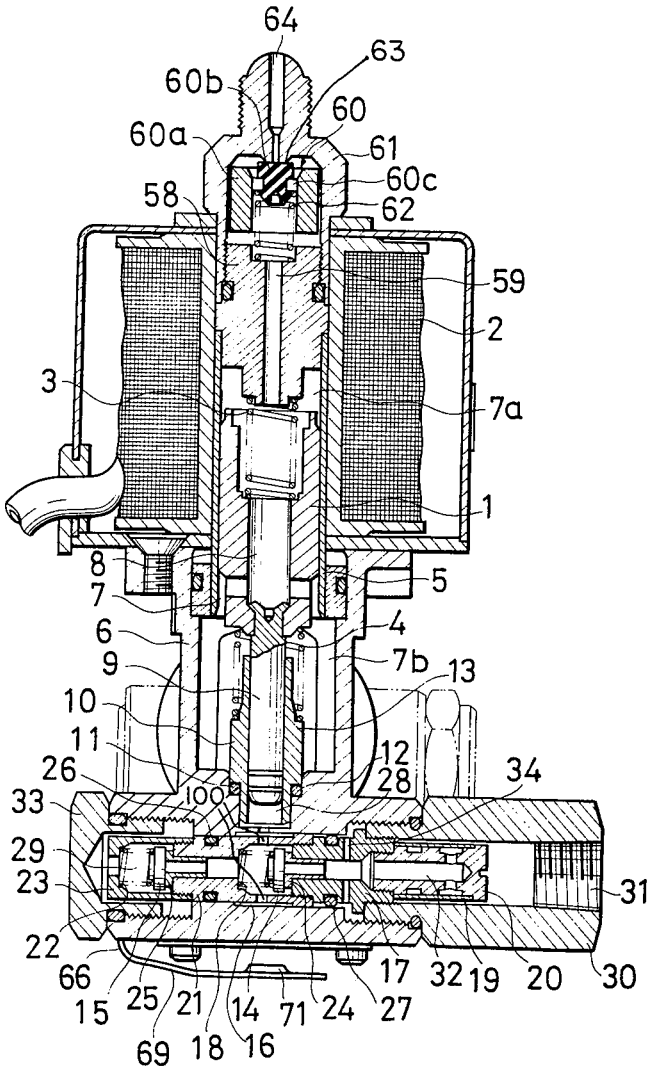
FIG. 2 is a cross-section taken along the line A—A of FIG. 1.
Figure 3:
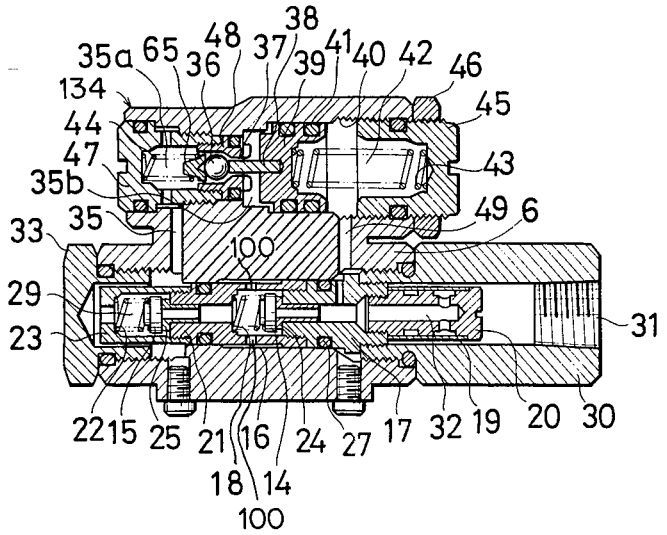
FIG. 3 is a cross-section taken along the line B—B of FIG. 1.
Figure 4:
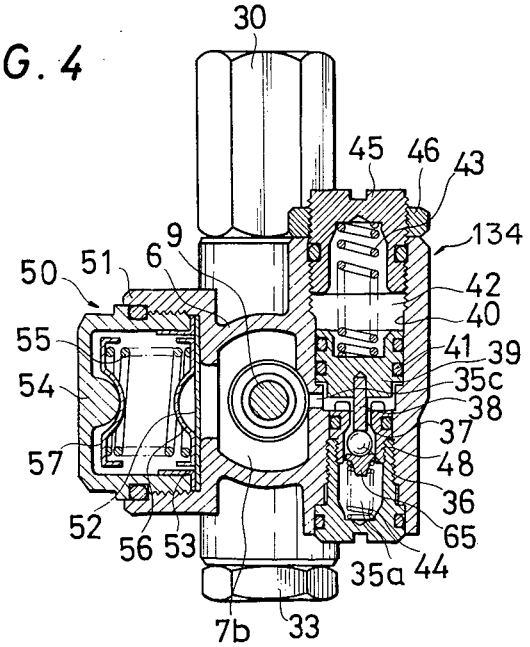
FIG. 4 is a cross-section taken along the line C—C of FIG. 1.

Anti-vibrating plates (66) for mounting the electromagnetic pump on the equipment are shown in FIG. 1 and FIG. 2. The pump is mounted by means of screws (68) through mounting holes (67) of the anti-vibrating plates (66), the mounting holes formed in a horizontal direction on both sides of the plates facing the coupling (30) on the suction side of the pump in the lower part of the electromagnetic pump proper (6). The anti-vibrating plates (66) are formed with a bottom plate (69) for mounting the pump; mounting holes (70) and (71) are bored on the bottom plate (69), and screws are inserted into the holes (70) and (71) so as to mount the pump. The anti-vibrating plates (66) have the functions of mounting the pump and absorbing the vibration thereof.

In the foregoing construction, when the interrupted current flows to the electromagnetic coil (2), the electromagnetic plunger (1) is caused to reciprocate, and the piston (9) is caused to reciprocate accordingly, so that a pumping action takes place because of the operation of the check valve (14) at the suction side and the check valve (15) at the discharge side, i.e.—when the plunger (1) moves in a direction away from the lower spring chamber (7*b*), the fluid is sucked through the suction hole (31) and enters the path (35) through the suction side check valve (14) and the discharge side check valve (15); the fluid passes through the throttle hole (37) formed on the path (35) and enters the lower spring chamber (7*b*) and passes through the hole (8) of the electromagnetic plunger (1); the fluid passes through the path (59) of the magnetic rod (58); the electromagnetic valve (60) is opened by means of the magnetic force of the electromagnetic coil (2) and the fluid is discharged through the discharge outlet (64).

The electromagnetic pump discharges the fluid of fixed pressure from the discharge outlet (64); if the pressure feeding power is increased, the pressure is increased between a nozzle (not shown), connected to the discharge outlet (64) and the pump chamber (28), the pressure increase caused by the fluid resistance of the nozzle; the increased pressure causes the pressure receiving plunger (39) to be displaced, a return force on the plunger being provided by the pressure adjusting spring (43), and this displacement is transmitted to the decompression valve (36) by means of the rod (38); the decompression valve (36) is shifted in the direction of increasing its throttling action, and the fluid flow is throttled by means of the interaction of the throttle hole (37) and the decompression valve (36), and the flow to the nozzle is thereby reduced, and the discharge pressure is adjusted automatically to a predetermined pressure. When the throttling action is effected by the decompression valve (36), the pressure in the pump chamber (28) is increased so that the stroke of the piston (9) is reduced, and pump suction is adjusted in proportion to the reduced flow discharge.

When the pressure from the discharge outlet (64) to the pump chamber (28) is decreased, the force equalibrium state with respect to the pressure adjusting spring (43), used for applying a force to the pressure receiving plunger (39), is lost, and a force is applied to the pressure receiving plunger (39) by the pressure adjusting spring (43); the decompression valve (36) is shifted in the direction of moderating the throttling action, and the discharge pressure for increasing the fluid flow is automatically adjusted to a predetermined pressure. When the throttling action is moderated by the decompression valve (36), the pressure in the pump chamber (28) is lowered, and as a result, the stroke of the piston (9) is increased, and the pump suction is adjusted in proportion to the discharge amount. The adjustment of the discharge pressure is performed by manually turning the screw (45), and the discharge pressure can be adjusted to an optimal predetermined pressure, the adjusted pressure set for the maximum performance of the electromagnetic pump, namely, the pressure adjusting range is set within the maximum discharge pressure for each nozzle used with the pump.

Since the pressure receiving plunger (39) is slidable in the cylinder (40) and is loosely fitted, the fluid working on the pressure receiving plunger (39) flows through the gap formed with the cylinder (40) and is collected in the chamber (42) of the opposite side of the decompression valve, but as the negative pressure at the suction side is applied to the chamber (42), the fluid which has flowed through the gap returned to the suction side of the electromagnetic pump so that there is no negative effects caused by the leaking fluid, and the pressure receiving plunger (39) can always operate at optimum sensitively. Moreover, since the elastic material (41), (for example, an O ring), is interposed in the gap of the pressure receiving plunger (39) and the cylinder (40), there is an improvement in the micro pulsation balancing effect.

The reciprocating motion of the piston (9) causes pressure pulsations in the fluid flowing through the pump. A portion of these pulsations may be absorbed by the pressure receiving plunger (39). However, the accumulator (50) is provided on the pump proper (6) to insure that the pressure pulsations are adequately absorbed.

What is claimed is:

1. In an automatic pressure holding electromagnetic pump having a check valve at its suction side and a check valve at its discharge side, and having an electromagnetic plunger mechanically connected to a piston and an electromagnetic coil, the electromagnetic coil arranged to move said electromagnetic plunger to thereby cause a reciprocating motion of the piston thereby enabling a pumping action by the pump to thereby cause the flow of fluid out of said pump; the improvement comprising:

a decompression valve for throttling said flow of fluid out of said pump at said discharge side thereof for controlling the pressure thereof;

a pressure receiving plunger mechanically connected to said decompression valve for displacing said decompression valve, said fluid at said discharge side of said pump being applied to said pressure receiving plunger for displacing said pressure receiving plunger in dependence upon the pressure of said applied fluid;

a cylinder, said pressure receiving plunger slidably arranged in said cylinder;

a chamber arranged to communicate with said cylinder;

a pressure adjusting spring arranged in said chamber, said spring being positioned to face said pressure receiving plunger for applying a force thereto;

a return conduit connected to said suction side of said pump and extending to said chamber;

whereby said pressure of said electromagnetic pump is adjusted by the displacement of said decompression valve, the change in the displacement of said decompression valve causing a change in the magnitude of the throttling of said flow of fluid out of said pump, and wherein fluid leaking into said chamber is returned to said suction side of said pump through said return conduit.

2. An automatic pressure holding electromagnetic pump as in claim 1, wherein said decompression valve further comprises an elastic O ring provided between said pressure receiving plunger and said cylinder.

3. An automatic pressure holding electromagnetic pump as in claim 1, wherein said decompression valve further comprises a valve seat having aperture, said valve seat adjustably mounted in said cylinder.

4. An automatic pressure holding electromagnetic pump as in claim 1, wherein said decompression valve comprises a spherical shaped throttle valve fixed to said pressure receiving plunger, said pressure receiving plunger controling the opening and closing of said throttle valve.

5. An automatic pressure holding electromagnetic pump as in claim 1, further comprising a pressure adjusting screw mechanically connected to said pressure adjusting spring for being rotated for adjusting the force of said spring on said pressure receiving plunger for adjusting the discharge pressure of said pump.

* * * * *